United States Patent [19]

Ehlscheid

[11] Patent Number: 4,969,862

[45] Date of Patent: Nov. 13, 1990

[54] METHOD AND APPARATUS FOR PRODUCING FOLDED ARTICLES

[75] Inventor: Guenter Ehlscheid, Neuwied, Fed. Rep. of Germany

[73] Assignee: Winkler & Duennebier Maschinenfabrik und Eisengiesserei GmbH & Co. KG., Neuwied, Fed. Rep. of Germany

[21] Appl. No.: 344,545

[22] Filed: Apr. 25, 1989

Related U.S. Application Data

[63] Continuation of Ser. No. 124,683, Nov. 24, 1987, abandoned.

[30] Foreign Application Priority Data

Nov. 26, 1986 [DE] Fed. Rep. of Germany ..... 3640373

[51] Int. Cl.[5] ..... B65H 45/28; B65H 45/16; B26D 5/20; B26D 1/12

[52] U.S. Cl. ..... 493/359; 493/357; 493/360; 493/421; 493/458; 83/110; 83/152; 83/155

[58] Field of Search ..... 493/357, 358, 359, 360, 493/420, 421, 458; 83/100, 110, 152, 155

[56] References Cited

U.S. PATENT DOCUMENTS

| | | | |
|---|---|---|---|
| 465,428 | 12/1891 | Cox | 83/110 |
| 640,100 | 12/1899 | Cottrell et al. . | |
| 1,279,826 | 9/1918 | Barber | 493/360 |
| 1,331,727 | 10/1920 | Seymour | 83/110 |
| 1,654,158 | 12/1927 | Barber | 83/110 |
| 1,822,954 | 9/1931 | Campbell . | |
| 1,961,266 | 6/1934 | Van Voorhis . | |
| 2,318,173 | 5/1943 | Luehrs . | |
| 2,353,445 | 7/1944 | Crafts | 493/359 |
| 2,435,881 | 2/1948 | Faeber | 493/359 |
| 2,555,267 | 5/1951 | Crafts | 493/357 |
| 2,846,003 | 8/1958 | Johnson et al. | 83/110 |
| 3,075,678 | 1/1963 | Huck . | |
| 3,222,964 | 12/1965 | Obenshain | 83/110 |
| 3,689,061 | 9/1972 | Nystrand . | |
| 3,773,322 | 11/1973 | Schlagbauer et al. . | |
| 3,847,046 | 11/1974 | Schmermund | 83/152 |
| 3,861,259 | 1/1975 | Hitch | 83/152 |
| 4,023,790 | 5/1977 | Gortowski | 493/419 |
| 4,034,973 | 7/1977 | Hams | 493/420 |
| 4,211,396 | 7/1980 | Michalik et al. | 493/357 |

FOREIGN PATENT DOCUMENTS

| | | | |
|---|---|---|---|
| 738367 | 8/1943 | Fed. Rep. of Germany . | |
| 6802168 | 10/1968 | Fed. Rep. of Germany . | |
| 2732641 | 2/1978 | Fed. Rep. of Germany . | |
| 3139117 | 4/1983 | Fed. Rep. of Germany . | |
| 818190 | 8/1959 | France . | |
| 1160698 | 8/1969 | United Kingdom | 493/359 |

OTHER PUBLICATIONS

"Siemens Papier-querschneiderantrieb" B41F, Prospekt E 242/1548 (8 pages).

*Primary Examiner*—William Terrell
*Attorney, Agent, or Firm*—W. G. Fasse; D. H. Kane, Jr.

[57] ABSTRACT

Folded articles, such as paper napkins, handkerchiefs, and the like are produced of an intially continuous web or sheet material which is moved into a folding machine in a feed advance direction at a controllable feed-in speed. The sheet material may be folded once lengthwise around the feed advance direction before it is cut by a cutter operating at equal time intervals. The cut sheet material sections are then accelerated and after the acceleration they are folded at least once crosswise around a direction perpendicularly to the feed advance direction, whereby the cut sections travel at a constant speed during the crosswise folding and subsequent stacking. The feed-in speed is kept constant as long as articles of a given size are being produced. When the article size is to be changed, the feed-in speed is accordingly changed. The folding machine is equipped with a speed controllable sheet feeding device upstream of the cutter and with a sheet accelerating device downstream of the cutter as viewed in the feed advance direction.

7 Claims, 3 Drawing Sheets

METHOD AND APPARATUS FOR PRODUCING FOLDED ARTICLES

This application is a File Wrapper Continuation Application of Ser. No.: 07/124,683, filed Nov. 24, 1987, now abandoned.

FIELD OF THE INVENTION

This invention relates to a method and apparatus for folding pieces of flat material such as sheets of paper or pieces cut off from continuous fabric webs, for example, napkins, handkerchiefs, and the like. The flat material is supplied as a continuous web which, if desired, may first be folded longitudinally and then cut into pieces of suitable length, whereupon the pieces are folded once or several times in a direction across the initial folding.

DESCRIPTION OF THE PRIOR ART

Methods and machines of the type described above are known. The known machines comprise one or several machine frames in which the following components are rotatably supported and at least partially driven, such as transport rollers, guide rollers, cutting rollers, prefolding rollers, folding rollers, and counter rollers. The circumference of these rollers and their r.p.m. is selected with due regard to the size, especially the length of the folded product to be produced on these machines. Customarily, the web is pulled off a supply roller and is first folded in the longitudinal direction and then transported over cutting rollers or a pair of cutting rollers followed by a horizontal folding cylinder, as viewed in the travel direction of the material. The so-called folding cylinder is capable to make a first fold also referred to as a quarter fold, as well as a second fold also referred to as a one-eighth fold. In the known machines it is necessary to exchange the cutting roller pair and the folding cylinder when the size of the folded product is to be changed. This exchange is necessary due to the change in the length of the individual sheets to be cut-off from the material web being supplied by the supply roller. The cut-off length of the individual sheet sections determines the size of the folded product, and the cut-off length in turn depends on the circumferential length of the cutting roller and the folding roller. Therefore, it is necessary to exchange these components in prior art machines. Thus, it is necessary to equip each conventional folding apparatus with several sets of differently dimensioned cutting rollers and differently dimensioned folding rollers. Conventionally, each machine will comprise three or four such sets.

OBJECTS OF THE INVENTION

In view of the foregoing it is the aim of the invention to achieve the following objects singly or in combination:

- to provide a method which makes it possible to fold flat material into folded products such as paper napkins and the like which may have different sizes in their folded condition;
- to avoid the above exchange of structural components in a folding apparatus by changing the operational speed of at least certain components in such a apparatus;
- to construct a folding apparatus capable of folding flat sheet sections into folded products of different sizes without exchanging the cutting and folding rollers when switching from one size and of folded article to another size;
- to avoid changing the r.p.m. of the cutting roller and the folding roller in a machine of the type described.

SUMMARY OF THE INVENTION

The above objects have been achieved according to the invention in a method in which the cutting or severing of the continuous web of flat material into sheet sections takes place independently of the format of the folded product at equal time spacings to form sheet sections. The severed sheet sections are accelerated after the cutting. However, the folding takes place at a constant speed in the cross-direction whereupon the folded product is placed in a stack. The supply speed of the web material, however, is changed when the size or format of the folded product is to be changed.

It is an advantage of the invention that all machine components for the cutting or severing of the web material and all components for the folding and depositing of the finished product operate at a respective constant speed for all product or format sizes. When a format or size change is necessary, only the supply speed of the web material to the cutting mechanism is changed. More specifically, when the size of the product is to be increased, the supply speed is increased. When the size of the folded format is to be decreased, the supply speed is also decreased. The present acceleration path downstream of the cutting mechanism, as viewed in the travel direction of the material, is necessary for forming time gaps of a length sufficient for the further handling of the cut-off sheet material sections. The acceleration brings each severed sheet section to a leading edge to leading edge spacing corresponding to a maximum spacing that is required for the largest possible article size. However, since the r.p.m. and the circumference of the cutting roller and of the prefolding roller as well as of the folding roller, are constant, it is necessary to adjust or change the angular position of the cutting knife on the cutting roller and also of the angular position of the prefolding edge on the prefolding roller. For this purpose the angular positions of the cutting knife and of the prefolding edge are adjusted respectively to the center of each sheet section or napkin blank.

The timing of the apparatus is determined by the initial length of the largest web section to be handled in the apparatus. This initial length is reduced as each cross-folding takes place so that the gaps between neighboring sheet sections become larger as the folding proceeds.

The apparatus according to the invention for performing the present method comprises a device for accelerating the web sections between the cutting mechanism and the folding or rather crossfolding mechanism. The acceleration device comprises a segmented roller running faster than the cutting mechanism. The acccleration device further comprises a transporting mechanism running as fast as the segmented roller and hence at the same speed as the seqmented roller. The transport mechanism feeds the web sections to a first folding device and, if applicable, also to a second folding device.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
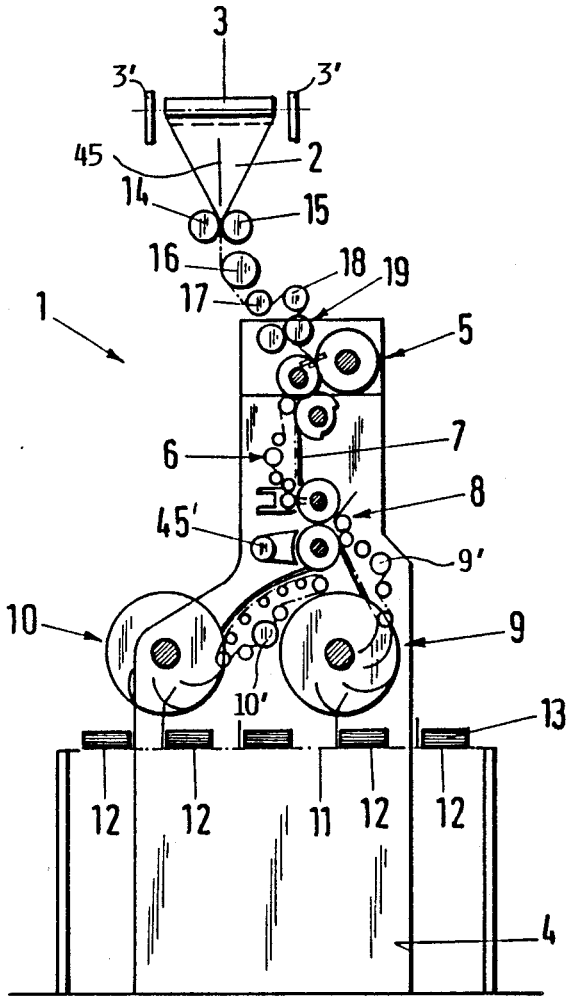
FIG. 1 shows a side view of an apparatus according to the invention partially in section, for producing folded papers and the like which are folded once in the longitudinal direction and once in the cross-direction relative to the feed advance direction of the cut sheet sections.

FIG. 1 shows a folding apparatus 1 for producing folded articles, such as paper napkins or the like, made of web material 2 supplied over a supply roller 3 rotatably supported on upright frame members 3' which in turn are supported by the machine base 4. A cutting mechanism 5 is arranged downstream of a first set of folding rollers 14 and 15 for folding the web 2 longitudinally about a substantially vertically arranged folding plate 45. The cutting mechanism 5 is also arranged downstream of a set of guide rollers 16, 17, and 18 and a pair of positively driven feed rollers 19. An acceleration device 6 is located downstream of the cutting mechanism 5. The acceleration device 6 also includes at least one positively driven roller 6' runs at a constant speed but faster than the cutting mechanism 5 and hence. The acceleration device 6 accelerates the movement of cut sheet sections 7 toward a crossfolding mechanism 8 arranged downstream of the acceleration device 6 as viewed in the feed advance direction. The cross-folded articles coming out of the cross-folding mechanism 8 are supplied to two stackers 9 and 10 of conventional construction. The stackers 9 and 10 alternately place the folded articles onto a table 11 to form stacks 12, each containing a plurality of folded articles 13. The stacks are removed from the table 11 of the folding apparatus by conventional means not shown.

If it is desired that the articles 13 to be folded should also have a longitudinal fold, the web 2 will be folded lengthwise about the above mentioned folding plate 45 leading the web 2 into a space between two folding rollers 14 and 15 before the web 2 is cut into sheets. The folding plate 45 folds the web 2 in a direction around the feed advance direction so that the web 2 will be folded lengthwise prior to being cut in the cutting mechanism 5. The cross-folding mechanism 8 performs a cross-folding, that is, the folding takes place around a direction extending crosswise to the feed advance direction.

Figure 3:
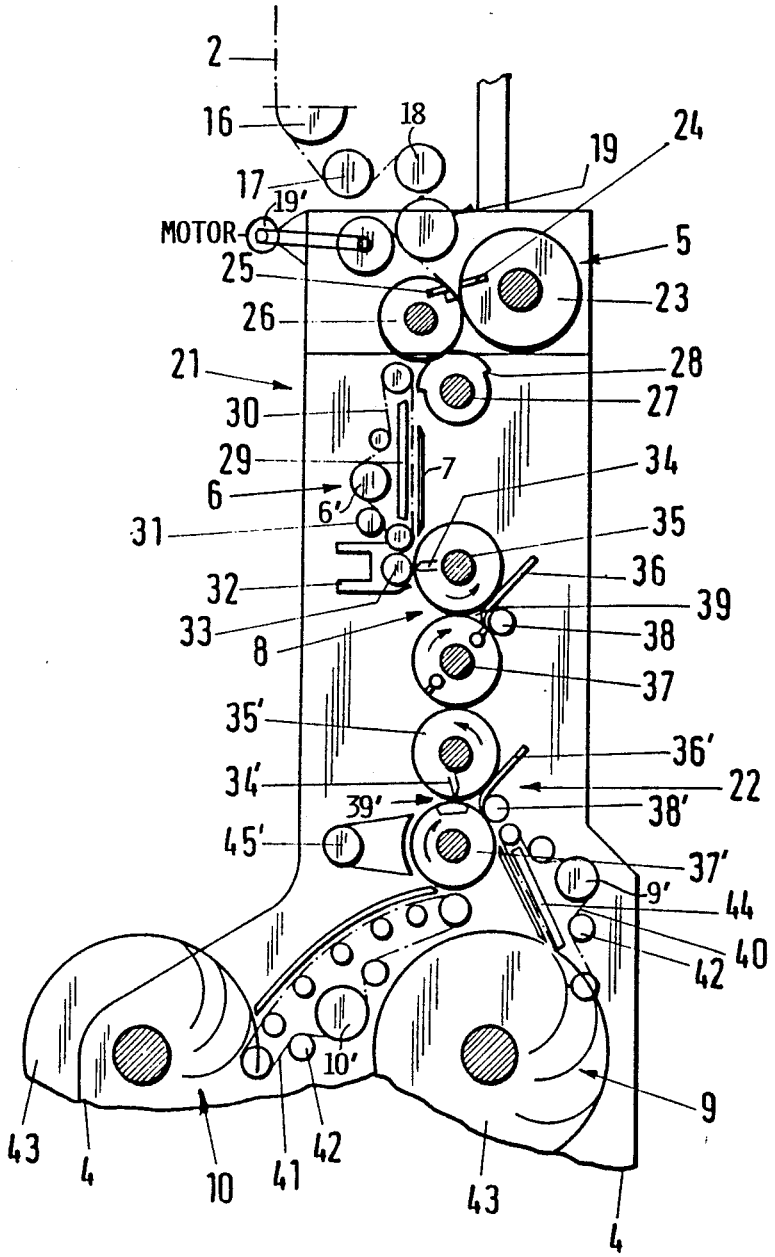
FIG. 3 is a partial view of the apparatus of FIG. 2 shown on a larger scale.

The pair of feed rollers 19 is positively driven by a speed adjustable motor 19' shown in FIG. 3. When a given size of folded articles 13 is to be formed, the motor 19' drives the web material 2 at a constant speed. The cutting mechanism 5 is always driven at a constant speed and the cutting takes place a time intervals of equal duration. However, when it is intended to increase the size of the folded article, the speed of the motor 19' is increased so that larger sheet sections from the web 2 are cut off, even though the cutter operates at constant time intervals. Similarly, when the size of the folded article 13 is to be decreased, the speed of the motor 19' is correspondingly decreased.

Downstream of the cross-folding device 8 there are conveyors 9' and 10' which comprise, for example, suction tapes or belts for alternately transporting the folded articles to the stackers 9 and 10 respectively.

Figure 2:
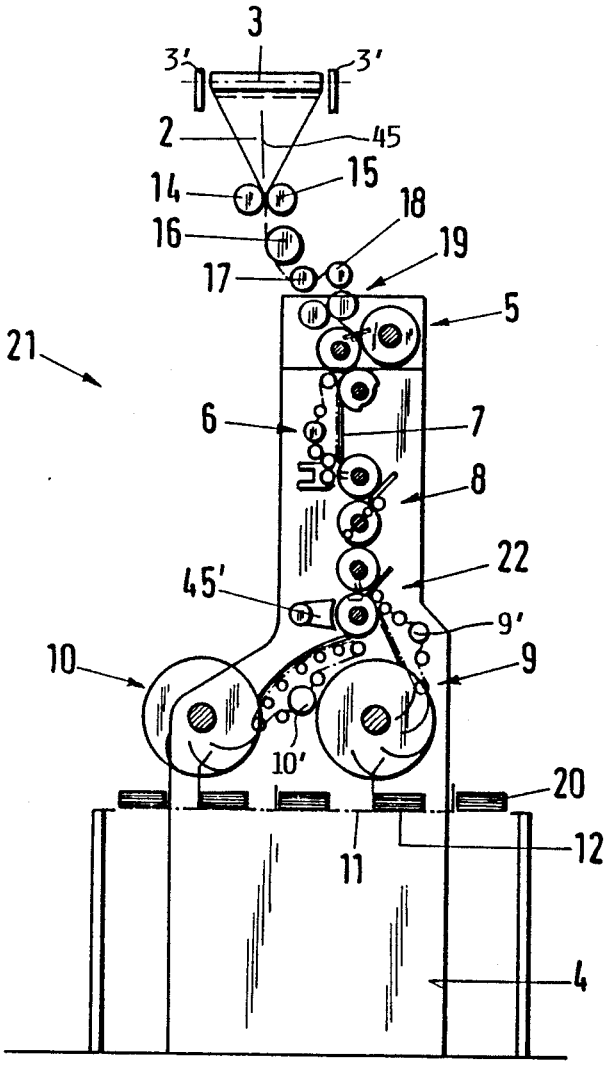
FIG. 2 is an apparatus similar to that of FIG. 1, however, equipped for making two folds in the cross-direction.

FIG. 2 shows an embodiment with a second cross-folding device 22 in addition to the cross-folder 8 for producing stacked articles 20 which have two cross-folds each. The folding device 22 is of the same construction as the folding device 8 as will be described in more detail with reference to FIG. 3. An emergency suction device 45' is so located that it can remove articles that may have gotten stuck.

As shown in FIGS. 1 and 2, the several stations in the present apparatus are arranged substantially vertically one below another as viewed in the feed advance direction. The function of the present apparatus, especially of the double-folding apparatus 21, will now be described with reference to FIG. 3.

The speed of the motor 19' is adjustable as mentioned above for selecting the proper feed-in speed depending on the size of the format to be folded. Once the particular size of a folded article has been selected, the speed of the motor 19' is kept constant for supplying the web 2 with the aid of the drive roller pair 19 to the cutting mechanism 5 comprising a cutting roller 23 with a cutting knife 24 and a counter-roller 26 carrying a counter tool or edge 25. A segmented roller 27 with a roller segment 28 is arranged downstream of the cutter 5 and runs faster than the cutting roller 23. The segmented rollers 27 is a friction roller and hence does not require any suction air. The segment 28 of the roller 27 projects radially outwardly of the roller 27 for transporting cut sheet sections 7 from the cutter 5 to the acceleration device 6 comprising at least a suction box 29 and suction tapes or conveyor belts 30 travelling over several guide rollers 31. The driven roller 6' runs at a constant speed but faster than the cutting roller for providing the required acceleration of the cut web section 7. The vertical length of the acceleration device 6, or rather, of its transport conveyor suction belt 30 and the required higher speed than the cutter 5 depend on the largest length of the cut sheet section 7 that is to be handled in the present apparatus. A mounting bracket 32 supports the acceleration device 6 in a vertical position. Additionally, the bracket 32 supports a counter-roller 33 cooperating with a prefolding edge 34 carried by a prefolding roller 35. The prefolding edge 34 presses the cut sheet 7 against said counter roller 33 to form a prefolding crease.

The first cross-folding mechanism 8 comprises a guide member 36 acting as a so-called folding pocket. The leading edge of a cut sheet section 7 runs onto the guide member 36 after the leading edge has been released by the prefolding roller 35 which operates at least at certain times as a suction roller. The prefolding roller 35 and the guide or folding pocket 36 cooperate with a folding roller 37 and a counter-folding roller 38. The folding roller 37 rotates at the same speed as the prefolding roller 35 and in a direction opposite to the rotational direction of the prefolding roller 35. The folding roller 37 takes up the cut web sheet section 7 from the prefolding roller 35 as soon as a defined length of a cut sheet section 7 has run into the folding pocket formed by the guide member 36. The transition from the prefolding roller 35 onto the folding roller 37 is caused by a respective control of the suction air which, for this purpose is switched off from the prefolding roller 35 and switched on for the folding roller 37 and vice versa.

As shown in FIG. 3, the first folding device 8 is followed by a second folding device 22 downstream of the first folding device 8. The second folding device 22 operates in the same manner as the first folding device. Hence, the device 22 also includes a prefolding roller 35', a prefolding edge 34', a guide member 36' forming a folding pocket, a folding roller 37' and a counter-folding roller 38' located in a position approximately next to the gap 39' formed between the prefolding roller 35' and the folding roller 37'. The guide member 36' is arranged at a slant just as the guide member 36 in the first folding device 8. Thus, the guiding member 36 reaches into the gap 39 and the guide member 36' reaches into the gap 39'. In both devices 8 and 22 the folding rollers 37, 37' run at the same constant speed as the respective prefolding rollers 35, 35'.

As soon as an article has been folded, it is transported into the stackers 9 and 10, each of which is equipped with a compartmented disk 43 for transporting the folded articles onto stacks 12 as shown in FIGS. 1 and 2. The folded articles 13, 20 are then immediately transported away out of the folding apparatus by conventional means as mentioned. The transfer from the last folding station 22 is accomplished with the aid of the conveyor means 9' and 10' comprising drive rollers, guide rollers, and a suction belt 40 with a suction box 44 in the device 9' and with a conveyor belt 41 in the device 10'. The folding roller 37' cooperates with the conveyor devices in the manner of a switch which is controlled to alternately supply a folded article to the stacker 9 or to the stacker 10. The control is accomplished by switching a reduced pressure in the roller 37' on or off so that the reduced pressure can be effective through openings in the surfaces of the roller 37' to supply an article to the device 10' or to supply an article to the suction tape 40 when the reduced pressure in the roller 37' is switched off. The emergency suction device 45' is also connected to a suitable source of reduced pressure and switched on only when a stuck article needs to be removed.

The following considerations apply with regard to the transport or circumferential speeds of the various rollers described above. The transporting speed of the acceleration device 6 including the circumferential speed of the segmented roller 27 should be adapted to the circumferential speed of the counter-roller 26 if the segmented roller 27 rotates in a direction opposite to that of the cutting mechanism 5. The suction tapes 30 have a larger speed than the cutting mechanism 5. Further, the transporting speed of the acceleration device 6 is always the same as the operational speed of the first folding mechanism 8 for the crossfolding, including its prefolding roller 35, its folding roller 37, and the counter-folding roller 38.

In those instances where a second cross-folding device 22 is provided, the roller dimensions will normally be maximally equal to the roller dimensions of the first cross-folding device 8.

Alternately, the dimensions of the components of the second cross-folding device 22 may be maximally that much smaller than the respective dimensions of the first cross-folding device 8 that the spacing between neighboring cut sections remains the same in spite of the first cross-folding.

Although the invention has been described with reference to specific example embodiments, it will be appreciated, that it is intended to cover all modifications and equivalents within the scope of the appended claims.

What I claim is:

1. An apparatus for producing folded articles of an initially flat continuous web material, comprising feed advance means (18, 19) for moving said web material in a feed advance direction, speed adjustable drive means (19') for driving said feed advance means (18, 19) at a first speed selected in accordance with a format size into which said web material is to be cut, whereby said first speed is constant but different for each selected format size, folding means (3, 14, 15, 45) for longitudinally folding said web material upstream of said feed advance means, a material cutting mechanism mounted in a fixed position downstream of said feed advance means and driven at a constant speed for cutting said web material across said feed advance direction at uniform constant time intervals into cut sheet sections the size of which is determined by a speed adjustment of said speed adjustment drive means (19'), sheet acceleration means arranged downstream of said cutting mechanism as viewed in said feed advance direction, said sheet acceleration means comprising a suction conveyor belt (30), a suction box (29) over which said suction conveyor belt runs, and a segmented sheet transfer roller (27, 28) arranged for transferring cut sheets from said cutting mechanism to said suction conveyor belt, said sheet acceleration means and said transfer roller having a constant second speed which is faster than the largest of said first speeds for accelerating said cut sheet sections from said first constant speed to said second constant speed, whereby changes in said format size can be made solely by changing the speed of said speed adjustable drive means, and folding means arranged downstream of said sheet acceleration means for receiving and folding said cut sheet sections, said folding means comprising a controlled suction prefolding roller (35), a folding pocket, and a suction controlled folding roller (37), said prefolding roller receiving suction air for transporting a cut sheet section into said folding pocket and said folding roller receiving suction air for removing a prefolded sheet section (7) from said folding pocket, whereby suction air is switched off for said prefolding roller (35) and switched on for the folding roller (37) and vice versa.

2. The apparatus of claim 1, wherein said folding means are arranged downstream of said suction conveyor belt (30) below said cutting mechanism substantially in vertical alignement with said cutting mechanism, said suction conveyor belt (30) also extending substantially vertically but laterally displaced from said vertical alignment.

3. The apparatus of claim 1, wherein said sheet acceleration means comprises means for controlling the speed of said suction belt to run at said constant second faster speed for bringing cut sheet sections from said first speed to said second faster speed.

4. The apparatus of claim 1, wherein said folding means further comprise, a guide member (36) for forming said folding pocket in cooperation with said suction controlled folding roller (37), and a counter-folding roller (38) cooperating with said folding roller (37).

5. The apparatus of claim 4, further comprising two stackers for stacking folded articles, and means for guiding folded articles from said folding means alternately to one or the other of said two stackers, said folding roller (37) and said counterfolding roller (38) forming part of said guiding means.

6. The apparatus of claim 1, wherein said prefolding roller (35) comprises a prefolding edge (34), said apparatus further comprising a counter roller (33) arranged for cooperation with said prefolding edge to press a prefolding crease into said cut sheet section (7) coming off said suction conveyor belt (30).

7. The apparatus of claim 1, wherein said prefolding roller (35) and said folding roller (37) also operate substantially at said second constant speed, so that said prefolding roller and said folding roller and said acceleration means always work substantially at the same speed.

* * * * *